US009522306B1

(12) United States Patent
Ganson

(10) Patent No.: US 9,522,306 B1
(45) Date of Patent: Dec. 20, 2016

(54) SPORTS BALL THAT MEASURES SPEED, SPIN, CURVE, MOVEMENT AND OTHER CHARACTERISTICS AND METHOD THEREFOR

(71) Applicant: Michael Ganson, Las Vegas, NV (US)

(72) Inventor: Michael Ganson, Las Vegas, NV (US)

( * ) Notice: Subject to any disclaimer, the term of this patent is extended or adjusted under 35 U.S.C. 154(b) by 0 days.

(21) Appl. No.: 14/869,725

(22) Filed: Sep. 29, 2015

(51) Int. Cl.
*A63B 43/00* (2006.01)
*A63B 37/02* (2006.01)

(52) U.S. Cl.
CPC ..... *A63B 43/004* (2013.01); *A63B 37/02* (2013.01)

(58) Field of Classification Search
CPC ..... A63B 24/0021; A63B 2024/0053; A63B 2024/0028; A63B 43/00; A63B 43/004; A63B 43/04; A63B 43/06; A63B 2225/50; A63B 37/02
USPC ..... 473/570
See application file for complete search history.

(56) References Cited

U.S. PATENT DOCUMENTS 4,775,948 A * 10/1988 Dial ..... A63B 69/0002 368/250
5,251,903 A * 10/1993 Bixler ..... A63B 43/00 473/140
5,526,326 A * 6/1996 Fekete ..... A63B 43/00 368/10
5,761,096 A * 6/1998 Zakutin ..... A63B 43/00 368/2
5,955,776 A * 9/1999 Ishikawa ..... C30B 25/18 257/1
6,148,271 A * 11/2000 Marinelli ..... A63B 43/00 473/198
7,273,431 B2 * 9/2007 DeVall ..... A63B 43/00 473/570
7,578,603 B2 * 8/2009 Huang ..... A63B 37/0003 362/276
7,766,766 B2 * 8/2010 Savarese ..... A63B 24/0021 473/351
7,779,686 B1 * 8/2010 Rothman ..... A63B 43/00 473/192
2005/0070376 A1 * 3/2005 Savarese ..... A63B 24/0021 473/353
2005/0261083 A1 * 11/2005 Liao ..... A63B 24/0021 473/353
2005/0288133 A1 12/2005 Rudell
2006/0105857 A1 * 5/2006 Stark ..... A63B 24/0021 473/353

(Continued)

OTHER PUBLICATIONS

Miniature Wireless IMU Enables Low-Cost Baseball Pitching Training Aid Ryan S. McGinnis, Noel C. Perkins, Kevin King http://www.asbweb.org/conferences/2011/pdf/274.pdf.

(Continued)

*Primary Examiner* — Steven Wong
(74) *Attorney, Agent, or Firm* — Weiss & Moy, P.C.; Jeffrey D. Moy

(57) ABSTRACT

A sports ball for calculating movement characteristics has a spherical core. A spherical circuit board is mounted within the spherical core. The spherical circuit board has components for monitoring and calculating the movement characteristics of the sports ball. The components are mounted on the spherical circuit board so the spherical circuit board is balanced. A winding is wrapped around the spherical core. A cover is positioned around the winding.

10 Claims, 5 Drawing Sheets

(56) References Cited

U.S. PATENT DOCUMENTS

| | | | | |
|---|---|---|---|---|
| 2009/0048044 | A1* | 2/2009 | Oleson | A63B 24/0062 473/570 |
| 2011/0118062 | A1* | 5/2011 | Krysiak | A63B 41/02 473/570 |
| 2012/0244969 | A1* | 9/2012 | Binder | A63H 33/18 473/570 |
| 2012/0255999 | A1* | 10/2012 | Luciano, Jr. | A63B 37/0003 235/439 |
| 2013/0073247 | A1* | 3/2013 | Perkins | G01C 21/16 702/141 |
| 2013/0073248 | A1 | 3/2013 | Perkins et al. | |
| 2013/0250047 | A1 | 9/2013 | Hollinger | |
| 2014/0045067 | A1* | 2/2014 | Cho | H01M 4/485 429/220 |
| 2014/0045630 | A1* | 2/2014 | Perkins | A63B 69/00 473/570 |
| 2014/0194233 | A1* | 7/2014 | Saegusa | A63B 37/00 473/570 |
| 2014/0235379 | A1* | 8/2014 | Nurnberg | A63B 43/004 473/570 |
| 2014/0256478 | A1* | 9/2014 | Gale | A63B 43/004 473/465 |

OTHER PUBLICATIONS

Advancing Applications of IMUs in Sports Training and Biomechanics. By Ryan McGinnis PhD Dissertation, University of Michigan, Ann Arbor Michigan IMU http://deepblue.lib.umich.edu/handle/2027.42/97947.

Perkins and King Develop the World's Smallest Wireless IMU News Archive College of Mechanical engineering, University of Michigan, Ann Arbor Michigan https://me-web2.engin.umich.edu/pub/news/newsitem?newsItemId=395.

A Highly Miniaturized, Wireless Inertial Measurement Unit for Characterizing the Dynamics of Pitched Baseballs and Softballs, Ryan S. McGinnis and Noel C. Perkins Sensors—Open Access Journal Published Aug. 29, 2012, http://www.mdpi.com/1424-8220/12/9/11933.

SKLZ Bullet Ball—Speed Detection Training Ball SKLZ http://www.amazon.com/SKLZ-Bullet-Ball-Detection-Training/dp/B002XT9A7K.

9" Baseball White Markwort Sporting Goods http:/shop.markwort.com/p/9-baseball-white.

* cited by examiner

SPORTS BALL THAT MEASURES SPEED, SPIN, CURVE, MOVEMENT AND OTHER CHARACTERISTICS AND METHOD THEREFOR

TECHNICAL FIELD

The present application generally relates to a sports ball, and more specifically to a balanced baseball that has the characteristic of a regulation baseball and measures other movement characteristics as deemed relevant to include the speed, spin rate, curve of the baseball.

BACKGROUND

In many sports it is desired to determine how fast a ball is being either thrown or hit. Typically, the speed of a moving ball is measured using a Doppler radar system. Doppler radar systems determine a moving ball's speed by analyzing radar beams reflected off the ball. Although accurate, these systems are expensive and normally cannot be operated by the athlete whose toss or hit is being measured. For these reasons, systems of this type are generally restricted to organized sport teams.

Just as important to speed is to know the motion characteristics of the ball, such as the distance, time of flight, speed, height, spin rate, curve, release point or other motion characteristics of the thrown or batted ball. All of the above characteristics may be used to help a pitcher optimize different types of pitches. For example, spin rate information is useful for example in optimizing a baseball pitcher's curve ball pitching ability. Unfortunately, the above motion characteristics are difficult to measure. In general, the above motion characteristics are generally calculated by videotaping a pitch and having a complex computer program analyze the different motion characteristics. Thus, as with speed, systems of this type are generally restricted to organized sport teams.

Thus, the ability to measure and review different motion characteristics of a pitched ball is generally reserved for professional sporting teams. The typical amateur ball player is unable to measure, review and analyze the different motion characteristics of a pitched ball.

Presently, there are sports balls which allow one to track the speed and other characteristics of the thrown and/or hit ball. However, these balls are not regulation caliber. Thus, the correlation between readings from these sports balls and throwing a regulation sports ball may not be accurate. Further, many of these sports ball are not balanced. Throwing an unbalanced sports ball creates false motion characteristics and could result in throwing injuries.

Therefore, it would be desirable to provide a system and method that overcomes the above.

SUMMARY

In accordance with one embodiment, a sports ball for calculating movement characteristics is disclosed. The sports ball has a spherical core. A spherical circuit board is mounted within the spherical core. The spherical circuit board has components for monitoring and calculating the movement characteristics of the sports ball. The components are mounted on the spherical circuit board so the spherical circuit board is balanced. A winding is wrapped around the spherical core. A cover is positioned around the winding.

In accordance with one embodiment, a sports ball for calculating movement characteristics is disclosed. The sports ball has a spherical core. A spherical circuit board is mounted within the spherical core. The spherical circuit board has components for monitoring and calculating the movement characteristics of the sports ball. The components are mounted on the spherical circuit board so the spherical circuit board is balanced. A mounting unit is formed within the spherical core for securing the spherical circuit board within the spherical core. The mounting unit has a platform housed within the spherical core and a plurality of mounting brackets positioned around a perimeter of the platform. The mounting brackets used to hold the spherical circuit board in place and deflect kinematic energy. A winding is wrapped around the spherical core. A cover is positioned around the winding In accordance with one embodiment, a sports ball for calculating movement characteristics is disclosed. The sports ball has a spherical core. A spherical circuit board is mounted within the spherical core. The spherical circuit board has components for monitoring and calculating the movement characteristics of the sports ball. The components are mounted on the spherical circuit board so the spherical circuit board is balanced. A mounting unit is formed within the spherical core for securing the spherical circuit board within the spherical core. The mounting unit has a cylindrical ring platform housed within the spherical core and a plurality of mounting brackets positioned around an inner perimeter of the cylindrical ring platform. The mounting brackets used to hold the spherical circuit board in place and deflect kinematic energy. A winding is wrapped around the spherical core. A cover is positioned around the winding.

BRIEF DESCRIPTION OF THE DRAWINGS

The present application is further detailed with respect to the following drawings. These figures are not intended to limit the scope of the present application but rather illustrate certain attributes thereof. The same reference numbers will be used throughout the drawings to refer to the same or like parts.

DESCRIPTION OF THE APPLICATION

Figure 1:
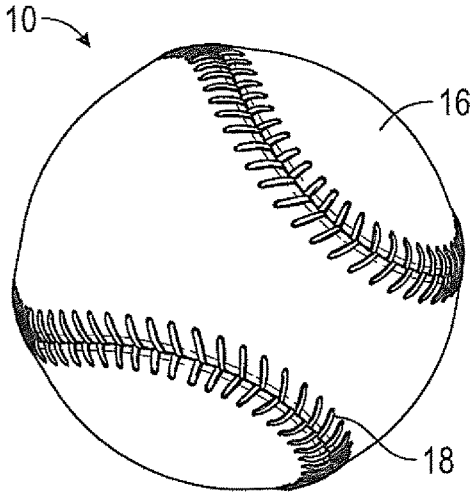
FIG. 1 is a prospective view of a sports ball for measuring a plurality of motion characteristics in accordance with one aspect of the present application.
Figure 2A:
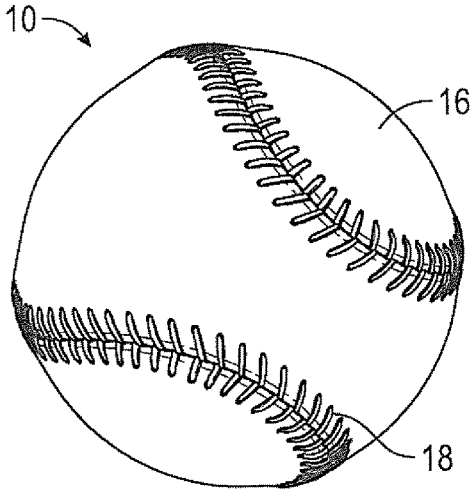
FIG. 2A-2D are prospective view of the different components of the sports ball of FIG. 1 in accordance with one aspect of the present application.
Figure 2B:
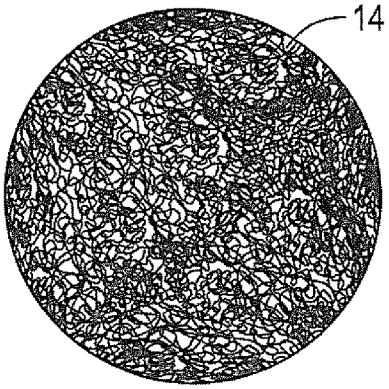
Figure 2C:
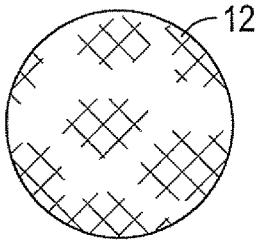
Figure 2D:
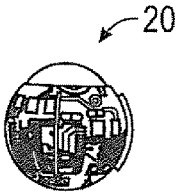
Figure 3:
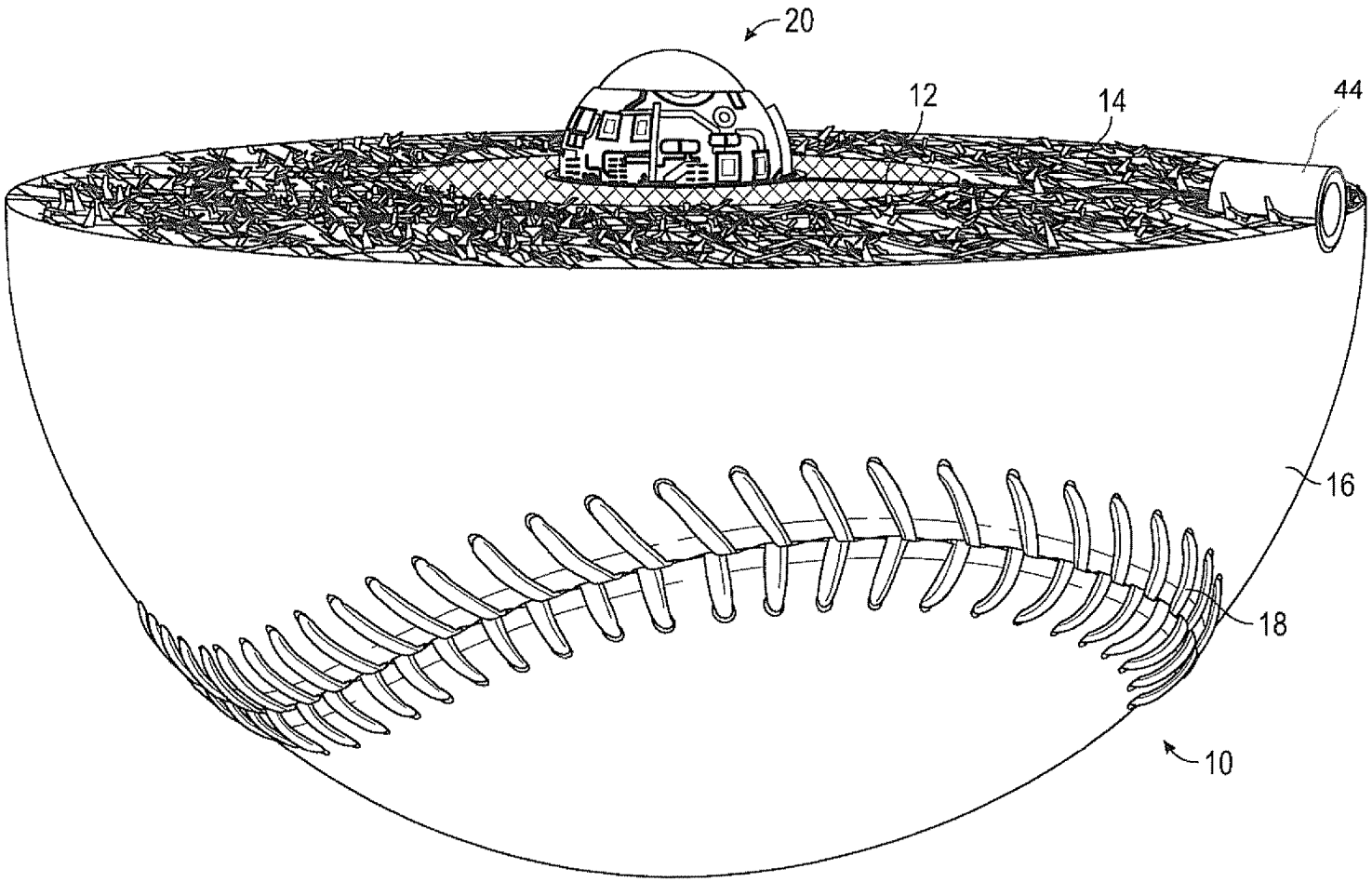
FIG. 3 is a cutaway view of the sports ball of FIG. 1 in accordance with one aspect of the present application.
Figure 4:
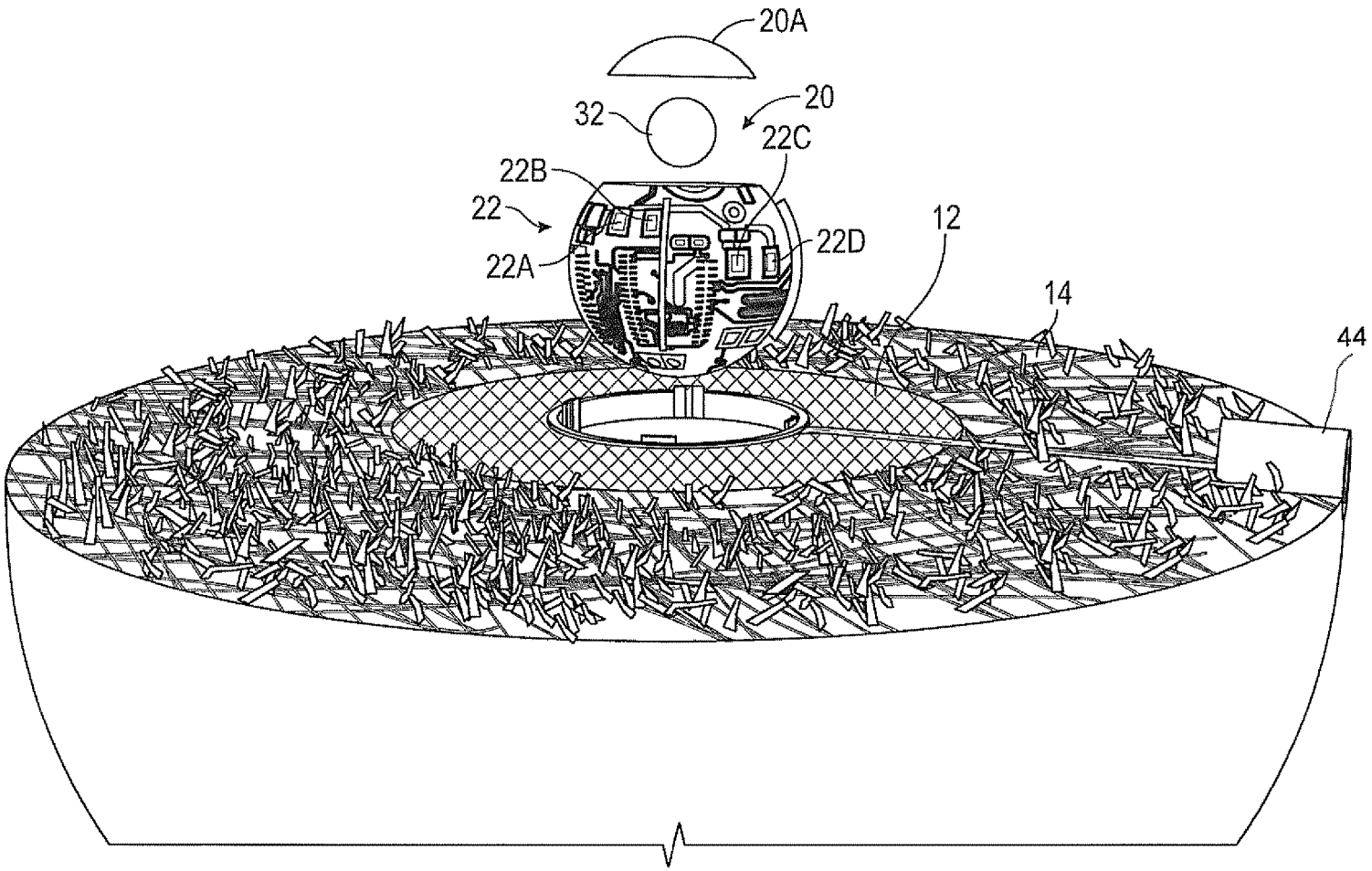
FIG. 4 is a magnified view of the measuring electronics and mounting system of the sports ball of FIG. 1 in accordance with one aspect of the present application.

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure.

Embodiments of the exemplary system and method disclose a regulation sports ball that is able to measure and record motion characteristics of the sports ball when the sports ball is thrown. The sports ball may be able to measure and record the speed, distance, time of flight, height, path, spin rate, curve, release point or other motion characteristics of the thrown ball. All of the above characteristics may be used to help a pitcher optimize different types of pitches.

Referring to the FIGS. 1-5, a sports ball 10 is shown. The sports ball 10 may be constructed to measure and record the speed, distance, time of flight, height, path, spin rate, curve, release point or other motion characteristics of the thrown sports ball 10. The sports ball 10 may be configured to conform to a regulation ball such as a baseball, bowling ball or other regulation sports balls. While embodiments shown in the Figures disclose a baseball, this should not be seen in a limiting manner.

In the embodiment shown, the sports ball 10 is a regulation baseball. Thus, the sports ball 10 may be configured to be between 9 and 9¼ inches in circumference, and 5 to 5¼ ounces in weight, and have a coefficient of restitution of no more than 0.578, no less than 0.514.

The sports ball 10 may be constructed in a similar manner to a regulation baseball. The sports ball 10 may have a spherical core 12. The spherical core 12 may be formed of cork, rubber or similar material. A winding 14 may be formed around the spherical core 12. The winding 14 may be formed of wool, poly/cotton or other winding material. A covering 16 may be formed around the winding 14 encompassing the core 12 forming an exterior surface of the sports ball 10. The covering 16 may be formed out of cowhide or similar material. The covering 16 may be formed out of natural or synthetic materials. The covering 16 may be formed in two hourglass shaped halves which may be couple together around the winding 14 encompassing the core 12 by stitching 18.

The sports ball 10 has a spherical circuit board 20. The spherical circuit board 20 may have a hollow interior section. Alternatively, the spherical circuit board 20 may be solid wherein the interior of the spherical circuit board 20 is a non-conductive substrate. A plurality of sensors 22 may be coupled to the spherical circuit board 20. The sensors 22 may be used to monitor different motion characteristics of the thrown sports ball 10. The sensors 22 may include: an accelerometer 22A to measure the speed of the thrown sport ball 10; gyroscope 22B to measure the rotation of the thrown sports ball 10; a position sensor 22C to monitor a location of the thrown sport ball 10; and a pressure sensor 22D to measure barometric pressure as to quantify a change in altitude as the sports ball 10 changes in elevation during delivery and to quantify atmospheric air density in the sports ball 10. The above list is given as an example. Other sensors may be used to measure different motion characteristics without departing from the spirit and scope of the present invention. In accordance with one embodiment, the sports ball 10 may be customized. Thus, a potential buyer of the sports ball 10 may designate which sensors 22 the buyer wishes to incorporate into the sports ball 10.

A processor 24 and memory 26 are coupled to the spherical circuit board 20. The sensors 22 may be coupled to the processor 24 and memory 26 via a plurality of conductive pathways 28. The processor 24 may be used to control the various functions of the sports ball 10. The processor 24 may store a computer program or other programming instructions associated with the memory 26 to control the operation of sports ball 10. The processor 24 may comprise various computing elements, such as integrated circuits, microcontrollers, microprocessors, programmable logic devices, etc, alone or in combination to perform the operations described herein.

The memory 26 may be coupled to the processor 24 as well as other components of the sports ball 10. The memory 26 may be used to store various data monitored by the sensors 22 and utilized by the processor 24 and or other components of the sports ball 10. The memory 26 may include removable and non-removable memory elements such as RAM, ROM, flash, magnetic, optical, and/or other conventional memory elements. The above listing is given as an example and should not be seen in a limiting manner.

The memory 26 may be used to store programming data for instructing the processor 24 or other components of the sports ball 10 to perform certain steps. For example, the processor 24 may obtain the various readings from the plurality of sensors 22. Using the programming data, the processor 24 may calculate a variety of movement characteristics of the sports ball 10. For example, the processor 24 may calculate travel route, distance, time of flight, speed, trajectory height, spin rate, curve of the sports ball 10, release point as well as the barometric change in elevation with the respect in the relative change in movement of the sports ball 10 prior to the release point and to quantify the atmospheric air density due to pitcher's elevation above sea level and other characteristics.

The processor 24 may be coupled to a transmitting device 30. The transmitting device 30 may send all of the data calculated by the processor 24. In accordance with one embodiment, the transmitting device 30 may have an antenna. The antenna of the transmitting device 30 may be incorporated into and form part of the stitching 18. The data may be transmitted over any type of wireless network. For example, the wireless network may be though a 3G cellular communications, such as CDMA, EVDO, GSM/GPRS, or 4G cellular communications, such as WiMAX or LTE or the like. Alternatively, the wireless communication may by using a wireless local area network (WLAN), for example, using Wi-Fi or the like. The above are given as an example and should not be seen in a limiting manner. Other types of wireless networks may be used without departing from the spirit and scope of the present invention. For example, the wireless network may include any wireless communication network associated with a Personal Area Network (PAN), a Local Area Network (LAN), Metropolitan Area Network (MAN), or a Wide Area Network (WAN).

The transmitted data may be sent to a computing device for review. For example, the transmitted data may be sent to a desktop computer, a laptop, a tablet, smartphone, or other computing devices. In accordance with one embodiment, a dongle or similar device may be attached to the computing device. The dongle may be used to aid the computing device in the reception of the transmitted data. The transmitted data may be sent to a server for storage. This may allow a user to review the data at a later time via a computing device. In this embodiment, a user may have to login to a website or via a software application of a mobile computing device to review the transmitted data.

Alternatively, the sports ball 10 may have a data cable 44. In this embodiment, the data monitored by the sensors 22 may be stored in the memory 26. A user may then connect the sports ball 10 to a computing device via the data cable 44 to download the information.

The components on the spherical circuit board 20 may be powered by a battery 32. The battery 32 may be positioned on the exterior surface of the spherical circuit board 20. Alternatively, the battery 32 may be placed within the interior of the spherical circuit board 20. Placing the battery 32 within the interior of the spherical circuit board 20, may allow the spherical circuit board 20 to be easier to spin balance. In accordance with one embodiment of the present invention, the battery 32 is a spherical battery positioned within the spherical circuit board 20. In this embodiment, a cap 20A may be removed from the spherical circuit board 20. The battery 32 may then be placed within the interior of the spherical circuit board 20. The battery 32 may be a rechargeable battery. The battery 32 may be may charged using wired or wireless technology. By using wireless technology such as by using an electromagnetic field to transfers energy for recharging of the battery 32, the sports ball 10 may become easier to balance.

The spherical circuit board 20, sensors 22 and other associated components are mounted together to be properly balance. Computer programs may be used to mathematically calculate the location of each component on the spherical circuit board 20. If not properly balanced, the spherical circuit board 20 may have one or more counter weights 34. The counter weights 34 may be used to balance the spherical circuit board 20. When the spherical circuit board 20 is constructed, the spherical circuit board 20 may undergo a balance spin test. This may allow one to see if the spherical circuit board 20 is properly balanced. If not, counter weights 34 may be added in predetermined positions to balance the counter weights 34. A balance spin test may show the location and amount of counterweight needed to properly balance the spherical circuit board 20.

A mounting unit 36 may be used to position the spherical circuit board 20 within the core 12. The mounting unit 36 may be used to dynamically balance the spherical circuit board 20 while anchoring the spherical circuit board 20 within the core 12. In accordance with one embodiment, the mounting unit 36 may have a platform 38. The platform 38 may be a cylindrical ring 38A. The spherical circuit board 20 may be positioned within the cylindrical ring 38A. A plurality of mounting brackets 40 may be positioned around a perimeter of the cylindrical ring 38A. The mounting brackets 40 may be structural shaped brackets that are used to hold the spherical circuit board 20 in place and deflect kinematic energy.

To enhance the ability to measure, review and analyze the different motion characteristics of a pitched ball, the person throwing the sports ball 10 may have one or more wearable devices 46. The wearable devices may be placed on the wrist, shoe or other areas of the person. The wearable devices may monitor different movement characteristics of the person throwing the ball. The wearable device may monitor arm slot and movement, stride of the person throwing the sports ball 10 and other movement characteristics of the person throwing the ball. This information may be used in conjunction with the transmitted data from the sports ball 10 to enhance the ability to measure, review and analyze the different motion characteristics of a pitched ball.

Figure 5:
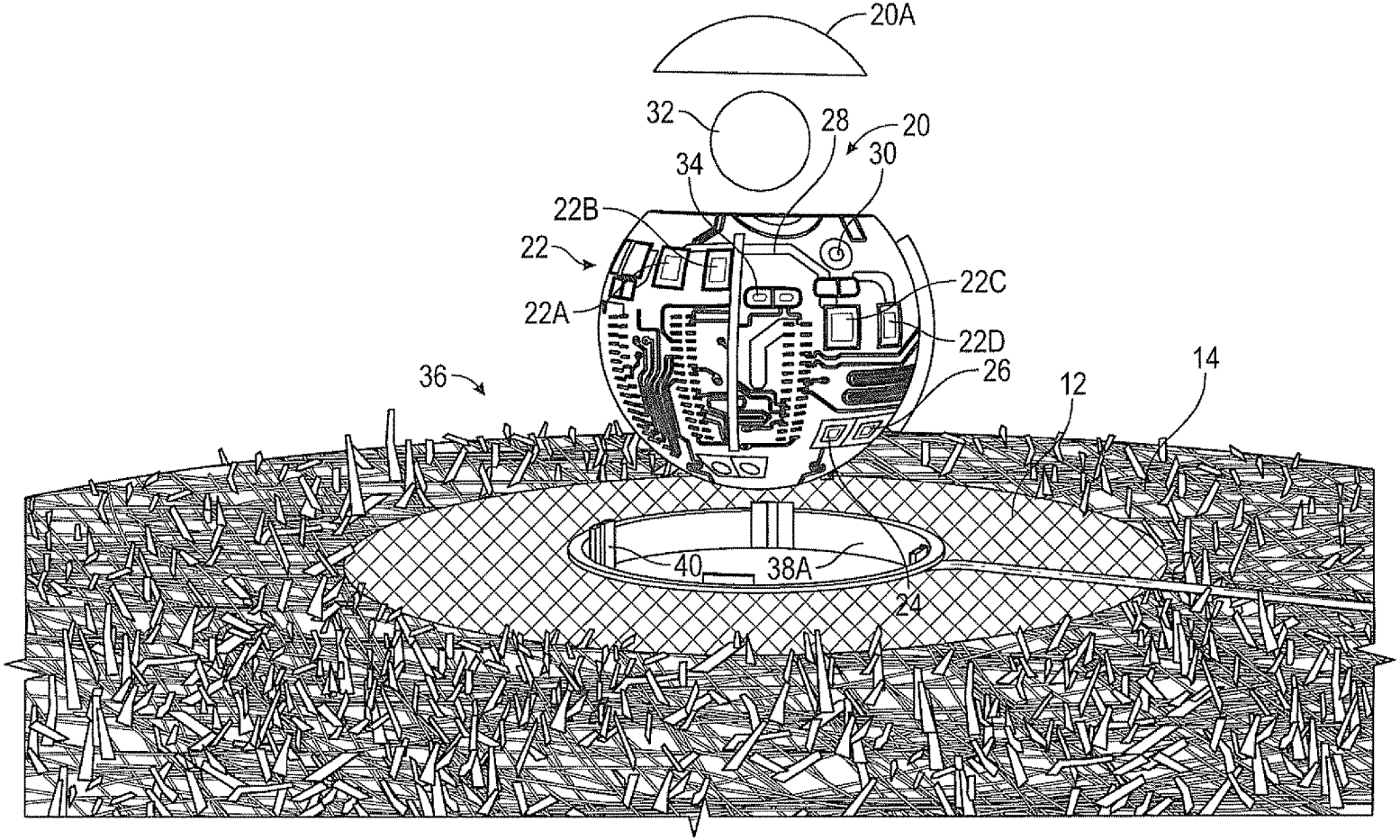
FIG. 5 is another magnified view of the measuring electronics and mounting system of the sports ball of FIG. 1 in accordance with one aspect of the present application.
Figure 6:
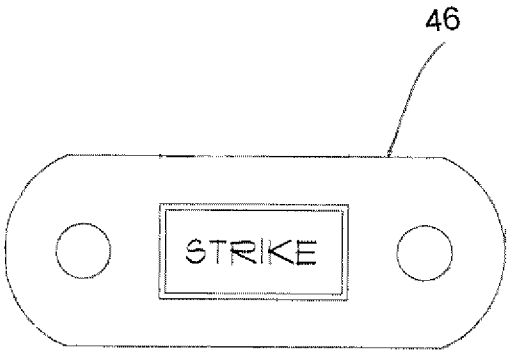
FIG. 6 is a front view of a wearable device used with sports ball of FIG. 1 in accordance with one aspect of the present application.

Referring to FIG. 6, one example of a wearable device 46 is shown. In this embodiment, the wearable device 46 is a foot pod that may be attached to the user's shoe. The foot pod may be used to measure the stride of the person throwing the sports ball 10 and other leg movement characteristics of the person throwing the ball. FIG. 5 shows just one example. As started above, wearable devices may be placed on the wrist or other areas of the person throwing the sports ball 10.

The foregoing description is illustrative of particular embodiments of the application, but is not meant to be a limitation upon the practice thereof. The following claims, including all equivalents thereof, are intended to define the scope of the application.

What is claimed is:

1. A sports ball for calculating movement characteristics comprising:
- a spherical core;
- a spherical circuit board mounted within the spherical core, the spherical circuit board having components for monitoring and calculating the movement characteristics of the sports ball, the components mounted on the spherical circuit board so the spherical circuit board is balanced;
- a mounting unit formed within the spherical core for securing the spherical circuit board within the spherical core, the mounting unit comprising:
  - a platform housed within the spherical core; and
  - a plurality of mounting brackets positioned around a perimeter of the platform, the mounting brackets used to hold the spherical circuit board in place and deflect kinematic energy;
- winding wrapped around the spherical core; and
- a cover positioned around the winding.

2. The sports ball in accordance with claim 1, wherein the platform is a cylindrical ring, wherein the plurality of mounting brackets is positioned around an interior perimeter of the cylindrical ring.

3. The sports ball in accordance with claim 1, further comprising counterweights positioned on the spherical circuit board.

4. The sports ball in accordance with claim 1, wherein the component comprises:
- a plurality of sensors for monitoring a plurality of movement characteristics of the sports ball;
- a processor coupled to the plurality of sensors; and
- a transmitter coupled to the processor.

5. The sports ball in accordance with claim 4, further comprising a battery.

6. The sports ball in accordance with claim 5, wherein the battery is positioned within the spherical circuit board.

7. The sports ball in accordance with claim 5, wherein the battery is a spherical battery positioned within the spherical circuit board.

8. A sports ball for calculating movement characteristics comprising:
- a spherical core;
- a spherical circuit board mounted within the spherical core, the spherical circuit board having components for monitoring and calculating the movement characteristics of the sports ball, the components mounted on the spherical circuit board so the spherical circuit board is balanced;
- a mounting unit formed within the spherical core for securing the spherical circuit board within the spherical core, wherein the mounting unit comprises:
  - a cylindrical ring platform housed within the spherical core; and
  - a plurality of mounting brackets positioned around an inner perimeter of the cylindrical ring platform, the mounting brackets used to hold the spherical circuit board in place and deflect kinematic energy;

winding wrapped around the spherical core; and a cover positioned around the winding.

9. The sports ball in accordance with claim 8, further comprising counterweights positioned on the spherical circuit board.

10. The sports ball in accordance with claim 8, wherein the component comprises:

a plurality of sensors for monitoring a plurality of movement characteristics of the sports ball;

a processor coupled to the plurality of sensors;

a transmitter coupled to the processor;

a battery positioned within the spherical circuit board; and counterweights positioned on the spherical circuit board.

* * * * *